United States Patent [19]

Diller

[11] Patent Number: 4,716,752

[45] Date of Patent: Jan. 5, 1988

[54] TUBE EXPANDING AND FLARING TOOL

[75] Inventor: Charles E. Diller, Springfield, Ohio

[73] Assignee: Dresser Industries, Inc., Dallas, Tex.

[21] Appl. No.: 862,776

[22] Filed: May 13, 1986

[51] Int. Cl.[4] ..... B21D 39/12

[52] U.S. Cl. ..... 72/118; 72/126

[58] Field of Search ..... 72/118, 119, 122, 123, 72/126, 112, 117, 124, 211, 241, 107

[56] References Cited

U.S. PATENT DOCUMENTS

| | | | |
|---|---|---|---|
| 1,046,457 | 12/1912 | Gilmor | 72/123 |
| 1,063,258 | 6/1913 | Haysom | 72/123 |
| 1,322,921 | 11/1919 | Maupin | 72/118 |
| 1,323,036 | 11/1919 | Faessler | 72/119 |

*Primary Examiner*—Lowell A. Larson

[57] ABSTRACT

A tube expanding and flaring tool comprising a rotatable cage which has a nose guide, size to be received in a tube end that is to be expanded and flared. The cage has a tail shaft by which the cage is to be rotated. There is at least one roller carried by the cage which extends partially through the cage for rolling engagement with the interior surface of the tube. There is a nose surface on the roller with a portion thereof tapering from a first diameter to a second relatively larger diameter. Also there is a truncated conical tail surface on the roller expanding at a predetermined angle form the second diameter to a third relatively large diameter. Further there is means for supporting the at least one roller in rolling engagement with the interior surface of the tube end with sufficient force to expand the tube to a diameter relatively larger than its original diameter and to flare the tube end at the predetermined angle of the truncated conical tail surface of the roller.

9 Claims, 5 Drawing Figures

TUBE EXPANDING AND FLARING TOOL

BACKGROUND OF THE INVENTION

1. Field of the Invention

This invention relates to an apparatus for expanding and flaring the end of tubular material. In particular this invention is useful for the expanding and flaring the end of a malleable thin walled tube to form a female end so that another tube having a male end can be guided by the flare into engagement with the expanded female end to form a rigid sealable joint.

2. Description of the Prior Act

Tools have been used in the past to expand the ends of tubes to form the female portion of a joint. However, where the end of the tube is alone expanded without also providing a flare, proper alignment of the tubes to be joined can be difficult. Examples of potentially difficult alignment problems include "in the field" conditions where alignment is accomplished by hand, in factory conditions where joints are made automatically by machinery which is not capable of detecting slight degrees of misalignment, or in situations where extremely close tolerances are maintained between the inside diameter of the expanded tube and the outside diameter of the joining tube.

Flaring tube tools have been divised which may require a separate operation to accomplish the flaring after the expanding of the tube end has been accomplished. Other tools beneficially expand and flare a tube end in one continuous operation. Such tools expand the tube using forming rollers. Typically the rollers have a substantially constant diameter cylindrical surface or have a nose which tapers to the single constant cylindrical surface. The flare is made with a chamfer surface on a collar which follows the rollers and contacts the end of the tube after the rollers are rotated into the tube end. The collar also holds the expanding rollers in place. The chamfer begins at a diameter equal to or smaller than the expanded end of the tube and expands outwardly to a diameter greater than the naximum diameter of the lip of the tube which is ultimately flared. This device has several drawbacks including wasted power and possibly resultant damage to the end of the tube being flared. As the entire surface of the flared portion of the tube is in contact with the champfered collar, excessive frictional energy loss results. Also high pressure must be exerted on the tool as it is pushed into the tube in order to cause the flaring to occur to a suitable degree. The excessive friction causes heat buildup, scoring and potentially even tearing of the lip of the tube as it is being expanded.

The present invention solves the problems of simultaneously expanding and flaring the end of tubular material as will become more apparent from the summary of the invention, the description and the drawings which follow.

Thus, it is an object of the present invention to provide an apparatus for expanding and flaring the end of the tube simultaneously while reducing the frictional power loss, the heat buildup, excessive tool pressure, and the tube end scoring and tearing problems and associated problems in the tube expanding and flaring art.

These and other objects and advantages will be more fully understood with reference to the drawings and descriptions of the preferred embodiments which follow.

SUMMARY OF THE INVENTION

Briefly the invention is a tube expanding and flaring tool comprising a rotatable cage which has a nose guide, size to be received in a tube end that is to be expanded and flared. The cage has a tail shaft in axial alignment with the nose guide, by which tail shaft the cage is to be rotated. There is at least one roller carried by the cage which extends partially through the cage for rolling engagement with the interior surface of the tube. There is a nose surface on the roller with a portion thereof tapering from a first diameter to a second relatively larger diameter. Also there is a truncated conical tail surface on the roller expanding at a predetermined angle from the second diameter to a third relatively large diameter. The tool further comprised means for supporting the at least one roller in rolling engagement with the interior surface of the tube end with sufficient force to expand the tube to a diameter relatively larger than its original diameter and to flare the tube end at the predetermined angle of the truncated conical tail surface of the roller.

DETAILED DESCRIPTION OF THE EMBODIMENTS

Figure 1:
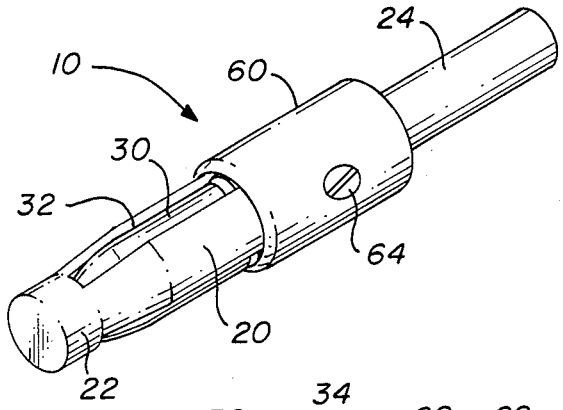
FIG. 1 is a perspective view of one preferred embodiment of the inventive expanding and flaring tool.
Figure 4:
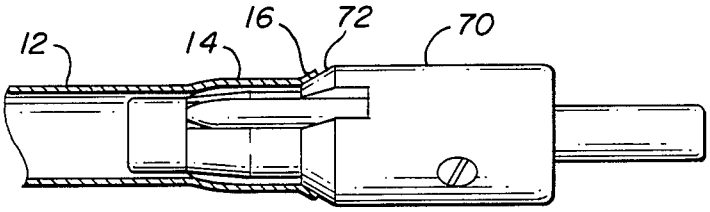
FIG. 4 PRIOR ART
FIG. 4 is a prior art expanding and flaring tool as it is being used inside a tube end which is shown in partial cross sections.

FIG. 1 is a perspective view of a tube expanding and flaring tool 10 comprising of rotatable cage 20 having a tube expanding and flaring tool 10 comprising a rotatable cage 20 having a nose 22 size to be received in a tube end (not shown in FIG. 1) that is to be expanded and flared. Details of the tube end can be had with reference to tube 12 with end 14 and flared lip 16 as shown in FIG. 4. Returning again to FIG. 1, it is seen that the cage 20 has a tail shaft 24 in axial alignment with nose guide 22 by which tail shaft 24 and the cage 20 is to be rotated. Rotation may be by any of a number of known electircal or pneumatic drill motors or rotation machines width chucks or collets sized to fit tail shaft 24.

Figure 2:
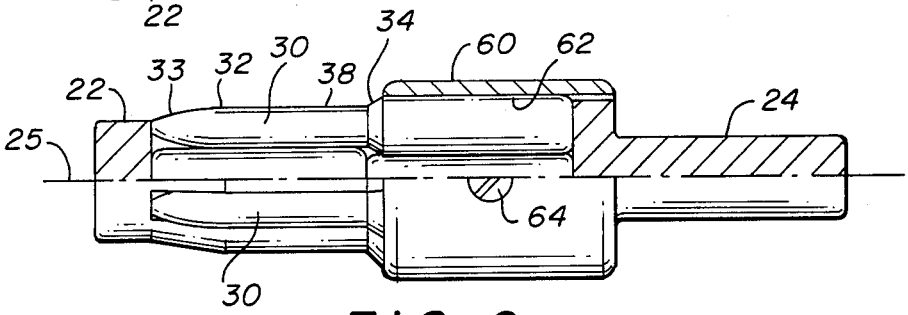
FIG. 2 is side view of one embodiment of the expanding and flaring tool shown with the roller cage and collar in partial cross section exposing the rollers and the roller supporting means which are carried by the cage.

With reference to FIG. 2, which is a partially cross-sectioned side view of one preferred embodiment of the inventive cage 20, the axial alignment of nose guide 22 with tailshaft 24 along axis 25 can be more fully understood. Also shown is at least one roller 30 carried by cage 20 and extending partially through cage 20 for rolling engagement with the interior surface of the tube which is to be flared. There is a nose surface 32 on the at least one roller 30 carried by cage 20 and extending partially through cage 20 for rolling engagement with the interior surface of the tube. A portion 33 of said nose surface 32 tapers from a first diameter 41 (as shown in FIG. 3*a*) to a larger diameter 43 (as shown in FIG. 3*b*).

Figure 3B:
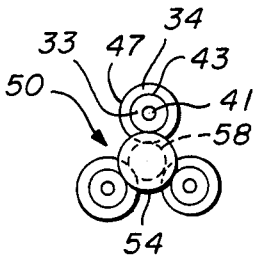
FIG. 3*b* is an end view showing three rollers and their relationship to the roller support means.
Figure 3A:
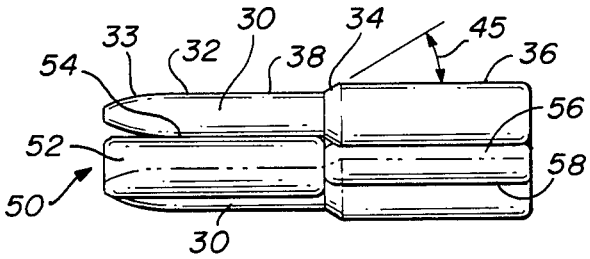
FIG. 3*a* is a side view showing the details of two rollers in their special relationship to the rollers support means with the cage removed from view.

Referring now to FIGS. 2, 3*a*, and 3*b*, there is a truncated conical tail surface 34, on said at least one roller 30, expanding at a predetermined angle 45 from said second diameter 43 to a third relatively larger diameter 47.

As can be seen in greater detail in FIGS. 3*a* and 3*b* there is a means, generally designated as 50, for supporting at least one roller 30 when it is in rolling engagement with the interior surface of the tube end. Means 50 supports said at least one roller with sufficient force to expand the tube to a diameter relatively larger than its original diameter and to flare the tube end at the predetermined angle 45 of the truncated conical surface 34 of roller 30.

It is possible to provide a tube expanding and flaring tool which employs a single roller 30 of the type described above. Such a single roller tool would be advantageous over previously known tools because it has a roller 30 which has the surface 32 with a portion 33 thereof tapering from the first diameter 41 to a relatively larger second diameter 43 and a truncated conical tail surface 34 expanding at a predetermined angle 45 from the second diameter 43 to a third relatively larger diameter 47. The expanding and flaring operation can be accomplished simultaneously using such a tool. Further as the flaring of the tube end is accomplished by substantially rolling contact with the truncated conical tail surface 34, friction is reduced. Also the risk of scoring and tearing of the flared lip is reduced.

In the preferred embodiments of the invention the tube expanding and flaring tool has more than one substantially identical rollers equally spaced circumfrentially about the cage. Preferrably the means for supporting the rollers comprises a mandrel carried by the cage in axial alignment along axis 25 with the tail shaft 24 and the nose guide 22 and positioned therebetween for rolling contact with the two circumfrentially opposed rollers. As the cage is rotated and the tool is inserted into the end of a tube the circumfentially opposed rollers contact the inner surface of the tube and are held outwardly in position by resisting forces transmitted through rolling contact with the mandrel.

It should be clear that multiple substantially identical rollers and in particular at least three substantially identical rollers 30 equally space circumfentially about the cage can be benefically used so that the wear on each individual roller is reduced, the work done by each roller being shared equally with the other rollers.

In the preferred embodiment roller 30 further comprises a substantially cylindrical portion 38 of the nose surface 32 with said second diameter 43 and a substantially cylindrical tail surface 36 having the third diameter 47 and extending tailward from the truncated conical surface 34. In this embodiment it is further benefical that the means 50 for supporting the roller comprises a first mandrel 52 having a cylindrical surface 54 for support contact with the cylindrical portion 38 of said roller nose having said second diameter.43. The first mandrel 52 is carried by the cage in axial alignment with and positioned between the caged tail shaft 24 and the cage nose guide.22. A second mandrel 56 having a cylindrical surface 58 for rolling support contact with said cylindrical tail surface is provided. The second mandrel 56 is carried by the cage 20 in axial alignment and positioned between the first mandrel 52 and the tail shaft 24. The mandrels are made of substantially incompressible material such as known roller bearing steel.

In order to provide radially support for the rollers, a tubular collar 60 is provided carried by the cage coaxially therewith. The collar 60 has an inside diameter at 62 substantially equal to the diameter of the second mandrel 56 plus two times the diameter of the cylindrical tail portion 36 of one of the rollers. The collar 60 is positioned at least partially over the cylindrical tail portions of the rollers such that the rollers receive the radially inward support from the interior surface 62 of the collar.60. Thus when the tool is being rotated into the end of a tube and begins contacting the tube with the tapered portion 33 of the nose surface of the roller, the roller is maintained in position and remains in contact with the mandrels. In other words it is not cantilevered about the curvature of the tapered portion 33.

Thus it can be seen that the rollers 30 are supported by mandrels 52 and 56 with sufficient radially outward force provided by the incompressability of mandrels 52 and 56. Further it should be observed that mandrel 52 rotates at a speed different from the speed of rotation of mandrel 56. A suitable lubricant can be beneficially used to further reduce the rolling friction between the mandrel and the rollers as well as the rolling and forming friction between the rollers and the tube end. As the truncated conical surface of the rollers also rolls against the lip 16 of tube 12 the friction involved in forming lip 12 is reduced to levels below the friction normally associated with sliding contact of the champfered surface 72 of collar 70 60 shown in FIG. 4 of a previously known expanding and flaring tool.

While the invention is described with respect to specific embodiment it is not intended to limit the invention to any particular embodiment but is intended to encompass all equivalents and subject matter and within the spirit and scope of the invention as it is claimed.

What is claimed is:

1. A tube expanding and flaring tool comprising:

a. A rotatable cage having a nose guide sized to be recieved in a tube end that is to be expanded and flared and said cage having a tail shaft in axial alignment with said nose guide by which said cage is to be rotated;

b. at least two substantially identical rollers carried by said cage equally spaced circumferentially about said cage and extending paritally through said cage for rolling engagement with the interior surface of said tube;

c. a nose surface, on said at least two rollers, with a portion thereof tapering from a first diameter to second relatively larger diameter;

d. a truncated conical tail surface, on said at least two rollers, expanding at a predetermined angle from said second diameter to a third relatively larger diameter; and e. means for supporting said at least two rollers in rolling engagement with the interior surface of said tube end with sufficient force to expand said tube to a diameter relatively larger than its original diameter and to flare said tube end at said predetermined angle of said truncated conical tail surface of said roller.

2. A tube expanding and flaring tool as in claim 1, wherein:

a. said rollers have a cylindrical surface portion of a diameter equal to said second diameter; and b. said means for supporting said rollers comprise a substantially cylindrical mandrel carried by said cage in axial alignment with said tail shaft and nose guide and positioned therebetween for rolling contact with said cylindrical portion of said at least two rollers.

3. A tube expanding and flaring tool as in claim 2, wherein said at least two rollers comprise at least three substantially identical rollers equally space circumferentially about said cage.

4. A tube expanding and flaring tool as in claim 3, wherein said at least two rollers further comprises a substantially cylindrical tail surface having said third diameter extending tailward from said truncated conical tail surface.

5. A tube expanding and flaring tool as in claim 1, wherein said at least two rollers further comprises:

a. a substantially cylindrical nose portion of said nose surface tailward of said tapered nose portion and having said second diameter; and b. a substantially cylindrical tail surface having said third diameter extending tailward from said truncated conical tail surface.

6. A tube expanding and flaring tool as in claim 5, wherein said means for supporting said rollers comprises:

a. a first mandrel having a cylindrical surface for rolling support contact with said cylindrical portion of said roller nose surface having said second diameter, said first mandrel being carried by said cage in axial alignment with and positioned between said cage nose guide and said cage trail shaft; and b. a second mandrel having a cylindrical surface for rolling support contact with said cylindrical tail surface, said second mandrel being carried by said cage in axial alignment with and positioned between said first mandrel and said tail shaft.

7. A tube expanding and flaring tool as in claim 6 further comprising a tubular collar carried by said cage coaxially therewith and having an inside diameter substantially equal to the diameter of said second mandrel plus two times the diameter of said cylindrical tail portion of one of said rollers and positioned at least partially over said cylindrical tail portions of said rollers such that said rollers receive radially inward support from the interior surface of said collar.

8. A tube expanding and flaring tool as in claim 7 wherein said at least two rollers comprise at least three substantially identical rollers equally spaced circumferentially about said cage.

9. A tube expanding and flaring tool comprising:

a. a rotatable cage having a nose guide sized to be received in a tube end that is to be expanded and flared, a tail shaft in axial alignment with said nose guide and by which said cage is rotated, and a substantially hollow body portion connecting said tail shaft to said nose guide;

b. three forming rollers carried by said cage substantially equally spaced circumferentially about said hollow body portion and partially projecting through said body portion for rolling engagement with the interior surface of said tube;

c. a nose surface portion, on each of said forming rollers, tapering from a first diameter to a second larger diameter;

d. a first substantially cylindrical surface portion, on each of said forming rollers, tailwardly adjacent said nose portion and having said second larger diameter;

e. a truncated conical surface portion, on each of said forming rollers, expanding at a predetermined angle from said second diameter to a third larger diameter;

f. a second cylindrical surface portion, on each of said forming rollers, having said third diameter and extending from said truncated conical surface tailward;

g. a first mandrel having a cylindrical surface sized for parallel rolling support of said first cylindrical surfaces of each of said rollers, said first mandrel positioned in said hollow body of said cage coaxially with and between said cage nose guide and tail shaft;

h. a second mandrel having a cylindrical surface sized for parallel rolling support of said second cylindrical surfaces of each of said rollers, said second mandrel positioned in said hollow body of said cage body coaxially with and between said first mandrel and said tail shaft; and i. a tubular collar carried by said cage coaxially therewith and having an inside diameter substantially equal to the diameter of said second mandrel plus two times the diameter of said cylindrical tail portion of one of said rollers and positioned at least partially covering said cylindrical tail portions of said rollers such that said rollers are maintained in rolling contact with said second mandrel.

* * * * *